US007021926B1

(12) United States Patent
Pierce

(10) Patent No.: US 7,021,926 B1
(45) Date of Patent: Apr. 4, 2006

(54) CANDLEWICK-FIXING DEVICE FOR BURNING CANDLEWICKS

(76) Inventor: Carol Pierce, 864 Mission St., San Luis Obispo, CA (US) 93405

( * ) Notice: Subject to any disclaimer, the term of this patent is extended or adjusted under 35 U.S.C. 154(b) by 27 days.

(21) Appl. No.: 10/710,010

(22) Filed: Jun. 11, 2004

Related U.S. Application Data

(63) Continuation-in-part of application No. 10/378,732, filed on Mar. 4, 2003, now abandoned.

(51) Int. Cl.
*F23Q 25/00* (2006.01)

(52) U.S. Cl. ..... 431/120; 431/144

(58) Field of Classification Search ..... 431/144, 431/120, 33
See application file for complete search history.

(56) References Cited

U.S. PATENT DOCUMENTS 1,572,316 A * 2/1926 Schroeder ..... 431/144
1,822,652 A * 9/1931 Gluckert ..... 431/144
3,775,037 A * 11/1973 Sande ..... 431/144
3,985,492 A 10/1976 Nunemaker
D293,365 S 12/1987 George
5,537,989 A 7/1996 York et al.
5,820,360 A 10/1998 Callahan
D412,997 S 8/1999 Wise
5,989,012 A 11/1999 Umfleet

* cited by examiner

*Primary Examiner*—Alfred Basichas
(74) *Attorney, Agent, or Firm*—William Keyworth; Bill & Mary Lou Inc.

(57) ABSTRACT

The candlewick-fixing device replaces the need for two tools with separate functions by combining both tools at opposite ends of one adjoining handle. On one end, an O-shaped candlewick hook allows one to straighten and reposition the candlewick without having to extinguish the flame. On the other end, a bell-shaped snuffer extinguishes the flame when one places the snuffer over the flame. The bell-shaped snuffer is attached to the long handle by a hinge that allows it to be rotated horizontally. The device includes a plate to rest the bell-shaped snuffer on when not in use.

8 Claims, 2 Drawing Sheets

CANDLEWICK-FIXING DEVICE FOR BURNING CANDLEWICKS

CROSS REFERENCE TO RELATED APPLICATIONS

This application is a continuation-in-part of U.S. Non-provisional patent application Ser. No. 10/378,732, "Combination Candlewick-Straightening Device and Candlewick Flame Snuffer" filed on Mar. 4, 2003, now Abandoned.

FEDERAL RESEARCH STATEMENT

Not Applicable

BACKGROUND OF INVENTION

This invention relates to a candlewick-fixing device for use on burning candlewicks. The device has two tools, one a candlewick extracting and positioning device and the other a candlewick extinguishing device. It is also concerned with a new method of candlewick straightening that facilitates the re-positioning of a burning candlewick, and with the convenience of having a tool for extinguishing the candle flame as part of the same device.

Often included on candle labels is an approximate burn time. In order to maximize the burn time duration, the candlewick should remain upright as it burns. This upright position keeps the flame centered, and the candle will burn evenly from the center outwards, rather than burning too much on either side.

Uneven burning can also create tall sidewalls after burning away the central portion of the candle. If the candle flame burns a hole in the thin sidewall, excess melted wax will pour out of the hole and leave a hot puddle of wax. This can leave an undesired mess and be a safety hazard.

Candlewicks are susceptible to drafts created by heaters, air conditioners, movement by people, and other similar factors. These conditions can cause the candlewick to lean towards one side and either burn unevenly or put out the flame in the wax. Constant heat from the flame of the leaning wick can eventually crack a glass candleholder.

Few products exist that assist in repositioning the candlewick once it has been lit and is burning. Many people use objects such as pens and silverware to reposition the candlewick, which damages the objects over time. Often these devices do a poor job of straightening the candlewick, requiring frequent re-manipulation of the wick, or the candle burns unevenly. Rather than damaging household objects, what is required is a specially designed candlewick-fixing device that uses a method of straightening the wick that is easily performed by positioning the device around the candlewick to allow repositioning the candlewick with a simple horizontal motion. The device should be crafted of a material resistant to heat and tarnishing.

People who frequently light candles commonly use candlewick flame snuffers. Snuffers come in many sizes and designs but must have an opening which surrounds the flame in order to block oxygen from reaching and reviving the flame when the snuffer is placed over the flame.

Typically, snuffers serve only one purpose: they extinguish candle flames. Other common candle apparatus include lighters and wick cutters. These are used with un-lit candles. With the advent of many different devices to aid in candle lighting, users may accumulate a large quantity of tools.

What is required is combining a candlewick-straightening device and a candlewick flame snuffer in a candlewick-fixing tool to eliminate the need for two separate tools for use with lit candles. This combination candlewick straightening device and candlewick flame snuffer allows one to straighten the candlewick while it is burning using a flame-resistant wire loop on one end of the device and to extinguish the flame using the snuffer on the other end.

SUMMARY OF INVENTION

The present invention provides a candlewick-straightening device and candlewick flame snuffer combined into one candlewick-fixing device. The combination device eliminates the need for two separate tools and provides one with both a method for straightening an ignited candlewick without having to extinguish the flame first, and a method for extinguishing the flame when desired.

The candlewick-fixing device is aesthetically pleasing with an angled shape that allows it to stand on its own. On one end of the device, a 16-gauge steel wire is bent to form a circular opening candlewick hook. This shape aids in the push-and-pull method of adjusting the candlewick. The hook slips over a candlewick as shown in FIGS. 3 and 4. One can pull the wick backward, forward, and side-to-side by bringing the candlewick hook loop down around the wick and moving the candlewick hook accordingly. As used in this application a candlewick straightening device is defined as one which may be positioned around a candlewick as shown in FIGS. 3 and 4. The inside diameter of the candlewick straightening device circular opening has been sized to straighten a candle wick by surrounding the wick, thus allowing horizontal motion to contact and adjust the wick. A range of inside diameters to provide ease of lowering the loop around the wick is ¼" (~6.35 mm) to ½" (~12.7 mm). Smaller diameters than this are too difficult to position around common candlewicks to be considered a candlewick straightening device. Candle wicking diameters are not readily available as wicking is selected by the thread count in the braid and the thread used. The diameter of a given weave will vary from batch to batch, and also the diameter of a wick will increase from cold conditions to burning conditions. An investigation into nominal candlewick diameters using a millimeter ruler shows that the cold diameter of wicks in typical candle sizes common around the home is in the range of 2 to 4 millimeters, however larger sizes are available and may be used in some specialty candles. The length of the handle shaft is approximately 9 inches to allow one easy access to candles in pillar candleholders. The thin, bent handle aids in easy maneuverability by allowing one to access thin candleholders and hard-to-reach places. On the opposite end of the handle, attached by a retainer pin on a rotating mechanism, is a bell-shaped snuffer. The snuffer aids in putting out the candle flame by trapping the oxygen inside a contained space and preventing fresh oxygen from reaching and reviving the flame. This method of extinguishing the candle flame is safer than blowing out the flame because it prevents melted wax from being blown off the candle. The rotatable mounting of the snuffer on the handle permits the user to place the snuffer over a candlewick with the handle at a variety of angles relative to the candlewick. This allows the user to keep their hands out of the path of the hot gases from the burning wick when extinguishing a candle.

OBJECTS AND ADVANTAGES

One object of this invention is to provide a candlewick-straightening device that does not require extinguishing a candle flame to reposition the wick.

A second object of this invention is to provide a candlewick-straightening device to replace the use of household objects to position a burning candlewick in order to save household objects from getting burned and becoming discolored.

A third object of this invention is to provide a candlewick-straightening device to facilitate longer and more even burning of a candle.

A fourth object of this invention is to provide a candlewick-straightening device in combination with a candle flame snuffer so the maintenance of a burning candle may be performed with a single candlewick-fixing device.

A fifth object of this invention is to provide a candlewick-fixing device that may be stored on any surface without damaging the surface.

BRIEF DESCRIPTION OF DRAWINGS

A more complete understanding of the present invention can be obtained by considering the detailed description in conjunction with the accompanying drawings, in which.

REFERENCE NUMERALS IN DRAWINGS

Figure 1:
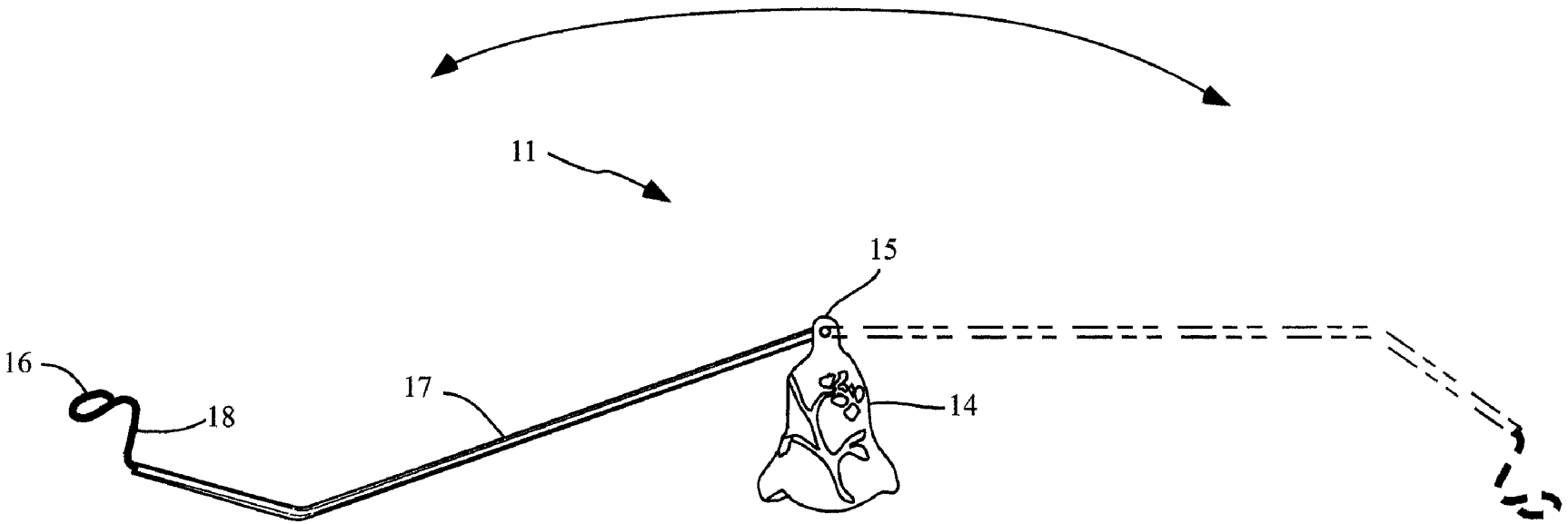
FIG. 1 is a side view of the candlewick-fixing device showing the range of rotating motion allowed by the retainer pin connecting the base of the snuffer to the handle.

These reference numbers are used in the drawing to refer to areas or features of the invention.

11 Candlewick-fixing Device
14 Snuffer
15 Retainer
16 Candlewick Hook
17 Handle
18 Candlewick Hook Stem
19 Candlewick
20 Plate

DETAILED DESCRIPTION

Preferred Embodiment

Figure 2:
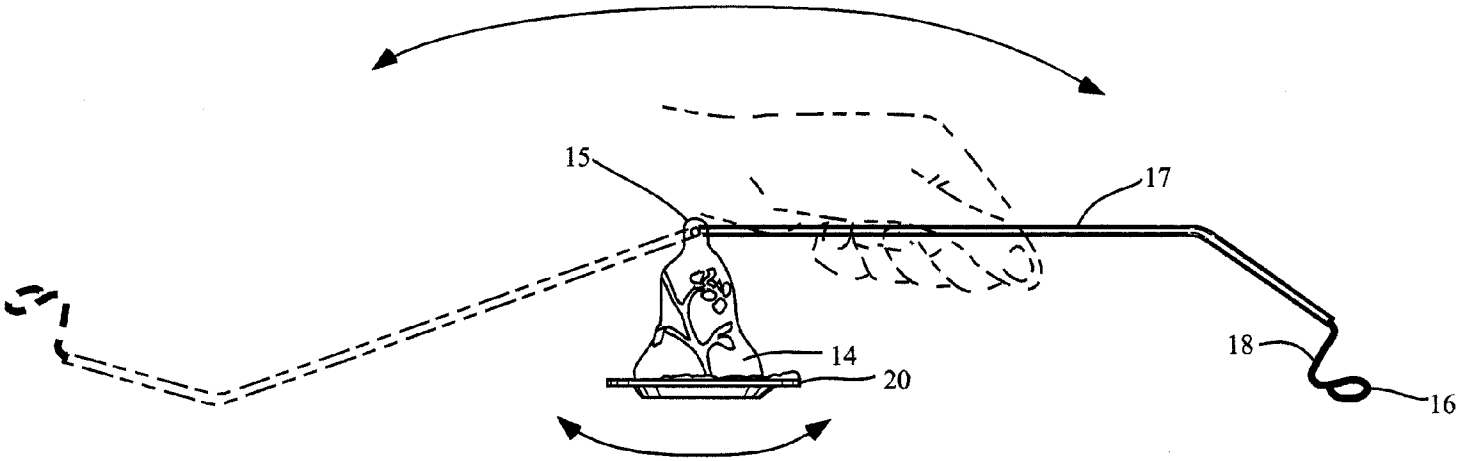
FIG. 2 is a side view of the candlewick-fixing device resting on the accompanying saucer illustrating the way in which one would hold the device in either position.

FIG. 1 illustrates the preferred embodiment of the candlewick-fixing device (11), a combination candlewick-straightening device and candlewick flame snuffer. The candlewick straightening device hook (16) is a metal wire formed into a circular loop shaped like the letter O, forming a circular opening. The candlewick hook has a stem (18) that connects to the device handle (17). Metal is used as it is resistant to the heat of a candle flame, and thin gage wire is used as it limits the heat transferred to the handle (17). The handle (17) is approximately 9 inches in length with a 45-degree bend two inches from the candlewick hook (16). On the opposite end of the handle (17), a brass bell-shaped flame snuffer (14) attachment end is attached to the handle (17) by a retainer (15). The retainer may be a pin, bolt or screw that attaches to the snuffer (14) attachment end and is sized to fit within a hole in the handle to permit rotating the handle (17) relative to the snuffer (14) through a limited arc as shown in FIGS. 1 and 2.

The handle (17) has a bend of about 45 degrees approximately 2 inches from the candlewick hook end. The bend convex side provides a rest for the handle when the device is not in use. FIG. 1 shows the device with the snuffer (14) resting on the plate (20). In the position shown, the bend in the handle (17) rests on the same support surface as the plate. In this position the candlewick hook (16) is elevated above the support surface so any debris on the candlewick hook will not mar the surface.

Figure 4:
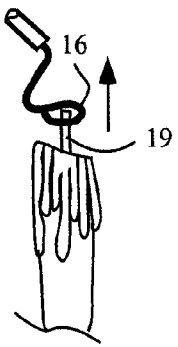
FIG. 4 is a close-up view of the O-shaped candlewick hook attached at one end of the candlewick-fixing device illustrating how one repositions the candlewick by pulling the candlewick hook back up once it has been looped around the slanted candlewick.
Figure 3:
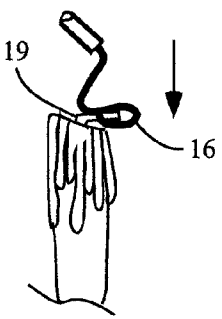
FIG. 3 is a close-up view of the O-shaped candlewick hook attached at one end of the candlewick-fixing device illustrating how one moves the candlewick hook down over the candlewick that has blown to one side.

The handle (17) may be rotated relative to the snuffer, as shown in FIG. 1, for use to make candlewick adjustments. The device is preferably in the position shown in FIG. 2 for straightening a candlewick. The candlewick hook stem (18) is bent at approximately a 90-degree angle relative to the end of the handle (17) and the candlewick hook (16) is at approximately a 90-degree angle to the candlewick hook stem. This places the candlewick hook at a plane approximately parallel to the handle. The candlewick hook (16) opening inside diameter is sized to be positioned over a candlewick (19) as shown in FIGS. 3 and 4. The opening has been sized to straighten a candle wick by being placed around the wick, thus allowing lateral motion of the straightening device to contact and adjust the wick. It has been found that openings less than ¼" make it difficult for many people to quickly and easily lower the loop around a candlewick. An opening inside diameter of ¼" (~6.35 mm) to ½" (~12.7 mm) provides ease of lowering the loop around most available candlewicks. An inside diameter of 5/16" (~7.9 mm) is preferred for common household use as it provides for ample clearance around typical wicks for ease of placing the straightening device in position, particularly for those with poor hand-eye coordination.

The snuffer (14) is a hollow bell shape sized to enclose a candlewick at its lower end. The snuffer-opening end has a concave opening at the bottom to permit the snuffer to enclose the candlewick. The opening is deep enough to allow enclosing most candlewicks without touching. Placing the snuffer over the candlewick retains combustion products within the snuffer, which exhausts the fresh air supply, thus extinguishing the flame. In the preferred embodiment the snuffer is brass.

When the candlewick-fixing device (11) is not in use, one can place the snuffer (14) on a plate (20) resting on a support surface. This prevents the snuffer from dirtying the wood, glass, or other material of the support surface it is desired to protect. Contact with the snuffer will dirty surfaces, as it would contain combustion products from use. While the retainer (15) allows the handle (17) to rest in either direction, it is preferable for the handle to be in the position shown in FIG. 1 so that the candlewick hook (16) does not touch the surface the device rests on.

Additional Embodiments

An alternate embodiment of the candlewick-fixing device is to make the handle of a material other than brass.

Alternatives are other metals, such as steel, bronze, pewter, rhodium, stainless steel, or aluminum; a ceramic; or heat resistant plastic. Hardwood may also be used if the length of the candlewick hook stem is long enough so the handle does not come in contact with the candle flame.

Another embodiment of the combination candlewick-straightening device and candlewick flame snuffer is to make the snuffer of a flame resistant material other than brass. Steel or a ceramic may be used.

Operation

The candlewick-straightening device is used as shown in FIGS. 2, 3, and 4. The user holds the handle (17) in the position as shown in FIG. 2 at the desired place depending on the preferred distance of the hand from the candle flame. When held properly, the candlewick hook stem (18) places the candlewick hook (16) at approximately a 45-degree angle from the portion of the handle in the hand. Referring to FIGS. 3 and 4, one lowers the candlewick hook (16) circular opening around the candlewick (19) and repositions the candlewick by moving the candlewick hook (16) horizontally forward, backward, side-to-side, or at an angle in between, depending on the adjustment needed.

The flame snuffer (14) may be used by holding the handle (17) in either the position shown in FIG. 1 or 2. Placing the snuffer (14) over the flaming candlewick extinguishes the flame without any candle wax spray or other hazards.

I claim:

1. A candlewick-fixing device for use with a burning candlewick comprising:

a. a handle with a first end and a second end;

b. a candlewick hook with a straight portion end and a bent portion end, the straight portion end attached to the handle second end, the hook bent portion end positioned adjoining a bend forming a circular opening, the handle first end sufficient distance from the second end such that the user may position the hook around a candlewick without encountering the heat from the candle;

c. the candlewick hook circular opening arranged with an inside diameter of one-fourth inch or greater such that the hook may be positioned around a candlewick wherein horizontal motion in any direction engages the candlewick and may be used to straighten the candlewick; and d. the handle first end connected to a flame snuffer with an opening end and an attachment end, the attachment end attached to the handle first end.

2. The candlewick-fixing device of claim 1 further comprising the handle is fabricated from a material chosen from the group consisting of metal, ceramic, plastic, and wood.

3. The candlewick-fixing device of claim 1 further comprising the handle contains a bend arranged such that the bend convex side may rest on a support surface such that any debris on the candlewick hook is elevated above the support surface.

4. The candlewick-fixing device of claim 1 further comprising a plate with an upper surface and a lower surface and configured such that the snuffer opening end may rest on the upper surface with the lower surface in contact with a support surface such that combustion products on the snuffer are deposited on the plate upper surface.

5. The candlewick-fixing device of claim 3 further comprising a plate with an upper surface and a lower surface and configured such that the snuffer opening end may rest on the upper surface with the lower surface in contact with a support surface such that combustion products on the snuffer are deposited on the plate upper surface.

6. The candlewick-fixing device of claim 5 further comprising the flame snuffer is rotatably mounted to the handle first end.

7. The candlewick-fixing device of claim 6 further comprising the handle is fabricated from a material chosen from the group consisting of metal, ceramic, plastic, and wood.

8. A combination candlewick straightening device and flame snuffer comprising:

a. means for repositioning a candlewick;

b. means for extinguishing a candle flame; and c. means for supporting the device and snuffer such that the candlewick repositioning means and the candle flame extinguishing means are elevated above the support surface.

* * * * *